US006244448B1

(12) United States Patent
Hang

(10) Patent No.: US 6,244,448 B1
(45) Date of Patent: Jun. 12, 2001

(54) BATHROOM BRACKET FREE OF INSTALLATION

(76) Inventor: Enzo Hang, 11F-1, No 214, Sec. 1, Wen Hsin Road, Taichung (TW), 406

( * ) Notice: Subject to any disclaimer, the term of this patent is extended or adjusted under 35 U.S.C. 154(b) by 0 days.

(21) Appl. No.: 09/565,242

(22) Filed: May 3, 2000

(51) Int. Cl.[7] ..... A47F 5/00

(52) U.S. Cl. ..... 211/105.1; 211/86.01; 211/104; D6/546

(58) Field of Search ..... 211/87.01, 105.1, 211/86.01, 104, 119.008, 119.089; D6/546, 549

(56) References Cited

U.S. PATENT DOCUMENTS

D. 261,337 * 10/1981 Fink .
D. 358,959 * 6/1995 Herstedt ..... D6/548
1,986,935 * 1/1935 Levine .
2,024,892 * 12/1935 Soper .
2,313,245 * 3/1943 Kent .
2,612,273 * 9/1952 Smith .
4,372,449 * 2/1983 Fink ..... 211/86.01
5,711,434 * 1/1998 Adams ..... 211/86.01
5,921,410 * 7/1999 Emery et al. .

* cited by examiner

*Primary Examiner*—Robert W. Gibson, Jr.
(74) *Attorney, Agent, or Firm*—Dougherty & Troxell; Kuo-Hsiung Chiu

(57) ABSTRACT

The present invention relates to a bathroom bracket which mainly includes a rack and two supporting legs. The rack has a plurality of cross rods for holding clothes and hanging towels. The two supporting legs are formed in curved shape. Each of the two supporting legs is contains a pivoting piece disposed at the top thereof and pivoted at a proper position of the bottom end of the rack. Each of the supporting legs includes a slotted part at the inner side thereof for hooking on a towel rack. Each of the supporting legs has a soft pad at the end thereof. The slotted part hangs on the towel rack whereby the soft pads at the bottom end of the supporting legs is pressed against a wall of the bathroom so that a stable fixing is achieved.

1 Claim, 2 Drawing Sheets

BATHROOM BRACKET FREE OF INSTALLATION

BACKGROUND OF THE INVENTION

1. Field of the Invention

The present invention relates to a bathroom bracket free of installation, and more particularly to a bracket directly fixed on the towel rack in the bathroom whereby the function of the towel rack is not influenced and the space to place objects can be effectively increased.

2. Description of the Prior Art

The space in the common bathroom is extremely limited so that it's hardly possible to install the brackets to place objects. Therefore, we always feel that the space in the bathroom is not enough for placing or washing clothes. Accordingly, how to make use of the bathroom space to meet the use requirements has always been the problem each user has to face every day. Moreover, it's hot and humid in the bathroom so that the user has to take the waterproof, moisture-proof and mold-resistant features of the bracket material into account. In a word, not every kind of bracket can be mounted in the bathroom.

In addition, the suspension racks or the hanging rods have become necessities in the bathroom. However, a drilling operation has to be performed to mount them on the wall. Generally, the user worries about insufficient tools to damage the wall tiles or the door panel in the bathroom so that he dares not to do it himself. To call for the professional help, however, costs too much. Moreover, it's not easy to dismantle the brackets. Also, many holes will be left after the user takes a forced dismantling, and these will destroy the whole appearance of the bathrooms.

Besides, it's common to use sticking or sucking hooks in the bathroom. However, they can be only temporarily used because of their insufficient bond strength or the plastic deformity.

SUMMARY OF THE INVENTION

It is a primary object of the present invention to provide a bathroom bracket which can be easily mounted on the existing objects in the bathroom to resolve the above-mentioned problems and to fully meet the using requirements.

It is another object of the present invention to provide a bathroom bracket which can be made in folding structure in order to spare the space in packaging, transport and storage.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
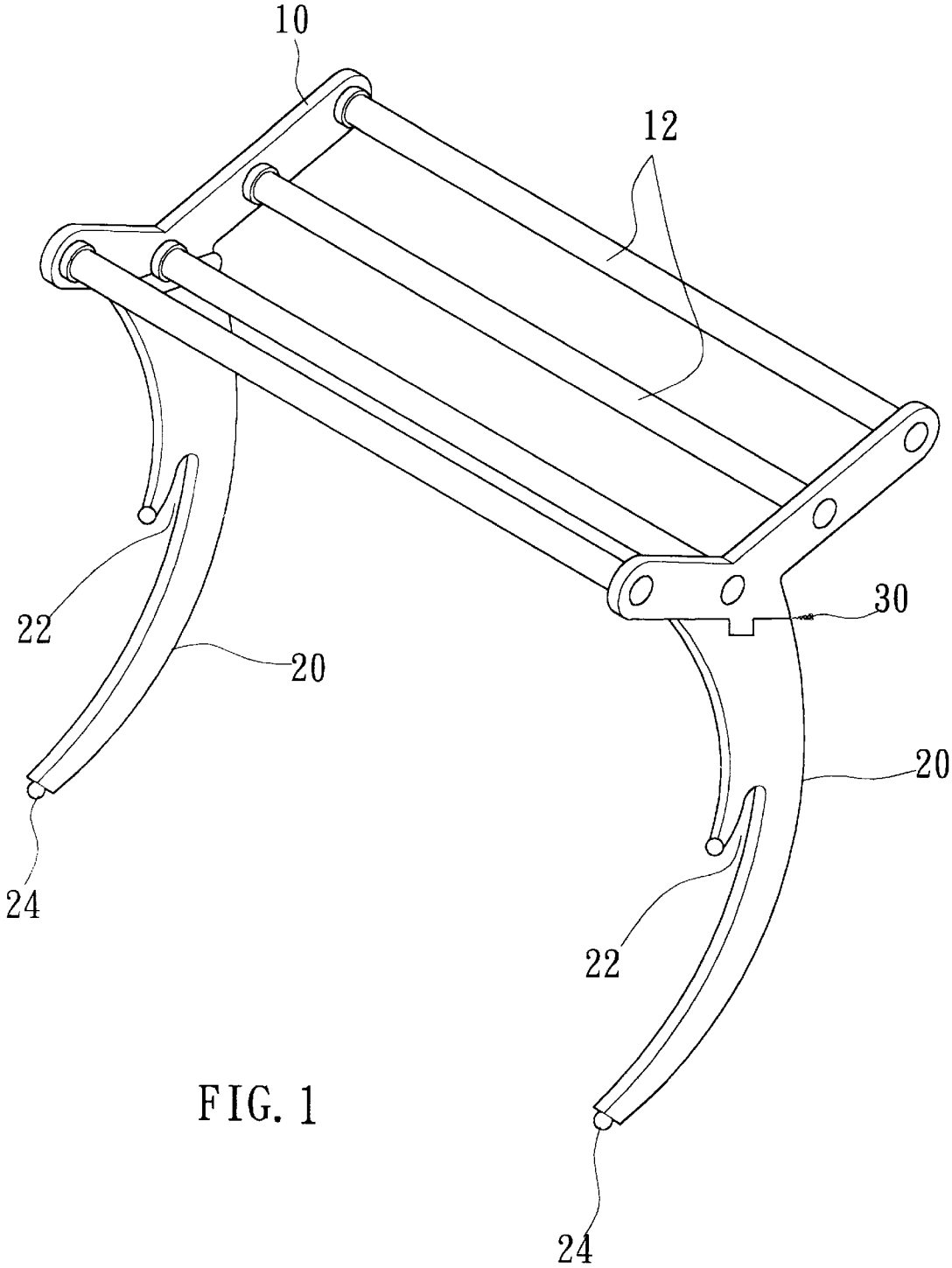
FIG. 1 is a perspective assembly view of a preferred embodiment of the present invention.

First of all, referring to FIG. 1, the bathroom bracket in accordance with the present invention primarily includes:

a rack 10 having a plurality of cross rods 12 for holding clothes and hanging towels and two supporting legs 20 formed in curved shape, each of said supporting legs 20 having a pivoting piece 30 disposed at the top thereof and pivoted at a proper position of the bottom end of said rack 10, each of said supporting legs 20 having a slotted part 22 at the inner side thereof for hooking on a towel rack 40, each of said supporting legs 20 having a soft pad 24 at the end thereof.

Figure 2:
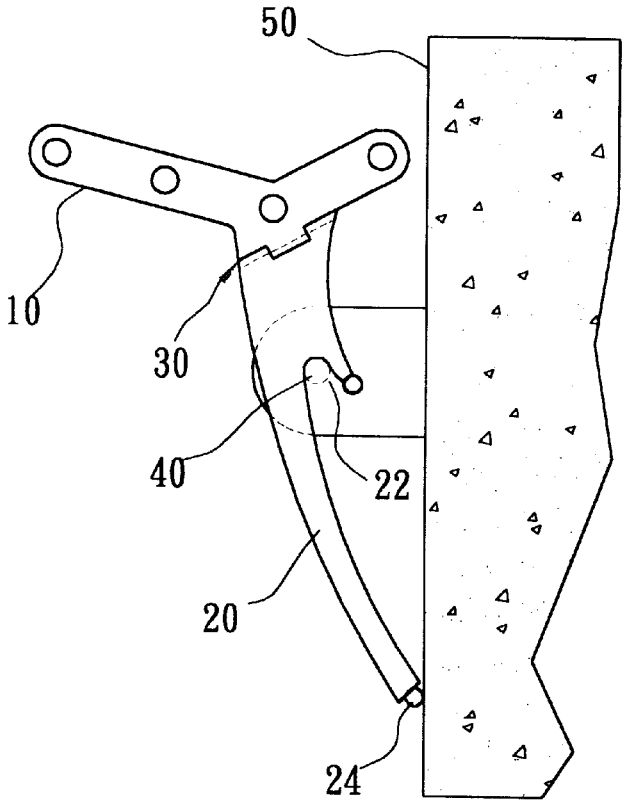
FIG. 2 is a schematic drawing of the preferred embodiment of the present invention in mounting on the wall.

A simple assembly of the above-mentioned parts is shown in FIG. 2. The slotted part 22 hangs on the towel rack 40 whereby the soft pads 2 at the bottom end of the supporting legs 20 is pressed against a wall 50 of the bathroom so that a stable fixing is achieved without any mounting operation. Moreover, the function of the towel rack 40 is not influenced and the space of the bathroom for placing objects can be effectively increased.

The pivoting piece 30 can be formed as hinge or spring locking pin (not shown) for a limited development and an inward folding. These parts belong to prior art and are not the feature of the present invention so that they won't be described hereinafter.

Figure 3:
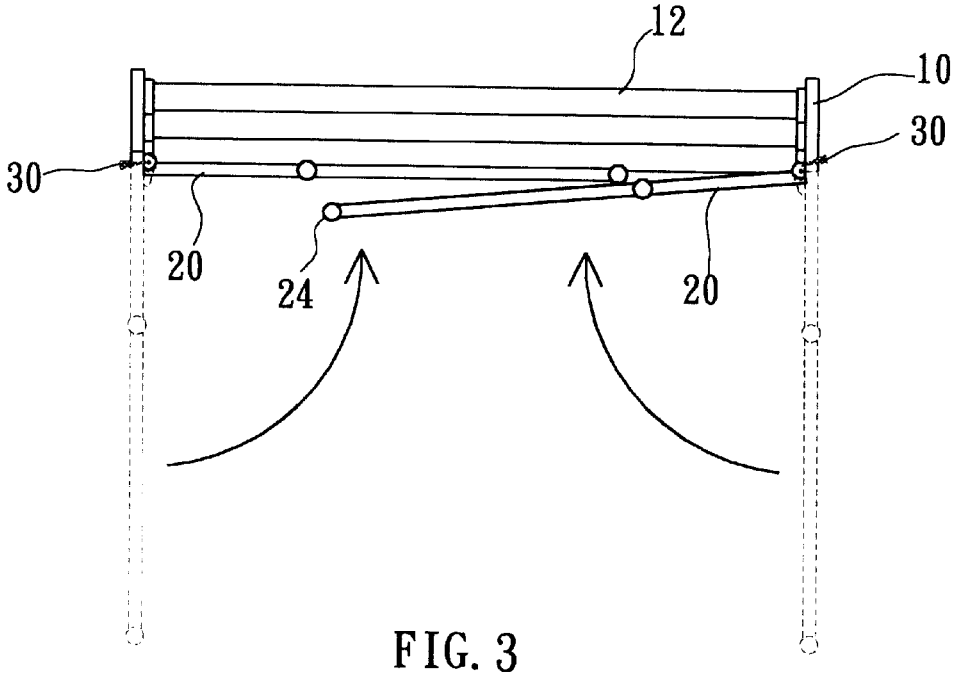
FIG. 3 is a schematic drawing of the present invention in folding state.

A folding design between the rack 10 and the supporting legs 20, as shown in FIG. 3, will be beneficial to the manufacturer in packaging, transport and to the user in storage.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claim.

What is claimed is:

1. A bathroom bracket comprising:

a rack having a plurality of cross rods for holding clothes and hanging towels and two supporting legs formed in curved shape, each of said supporting legs having a pivoting piece disposed at a top thereof and pivotally connected to a bottom of said rack, each of said supporting legs having a slot at an inner side thereof for hooking on a towel rack, each of said supporting legs having a soft pad at an end thereof, wherein, when said slot is engaged by a towel rack, said soft pads at the bottom ends of said supporting legs are pressed against a wall so that a stable attachment is achieved.

* * * * *